US012276186B2

(12) United States Patent
Narhi et al.

(10) Patent No.: US 12,276,186 B2
(45) Date of Patent: Apr. 15, 2025

(54) CONTROLLING HYDRAULIC FRACTURE GROWTH USING STRESS SHADOWS

(71) Applicant: ExxonMobil Technology and Engineering Company, Spring, TX (US)

(72) Inventors: Ward E. Narhi, Kingwood, TX (US); Holger A. Meier, Montgomery, TX (US); Yueming Liang, Sugar Land, TX (US); Kendal K. Decker, Spring, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 18/644,526

(22) Filed: Apr. 24, 2024

(65) Prior Publication Data

US 2024/0410262 A1 Dec. 12, 2024

Related U.S. Application Data

(60) Provisional application No. 63/506,998, filed on Jun. 8, 2023.

(51) Int. Cl.
*E21B 43/26* (2006.01)
*E21B 43/17* (2006.01)

(52) U.S. Cl.
CPC ..... *E21B 43/26* (2013.01); *E21B 43/17* (2013.01); *E21B 2200/20* (2020.05)

(58) Field of Classification Search
CPC ..... E21B 43/26; E21B 43/17; E21B 2200/20
See application file for complete search history.

(56) References Cited

U.S. PATENT DOCUMENTS 6,543,538 B2 * 4/2003 Tolman ..... E21B 43/116 166/308.1
8,967,262 B2 * 3/2015 Jo ..... E21B 43/26 166/308.1

(Continued)

FOREIGN PATENT DOCUMENTS

EP 2774066 B1 * 5/2019 ..... E21B 43/26
WO WO-2015069817 A1 * 5/2015 ..... E21B 43/26
WO WO-2018147756 A1 * 8/2018 ..... E21B 33/134

OTHER PUBLICATIONS

Oilfield Geomechanics (Year: 2015).*

*Primary Examiner* — Aaron L Lembo
(74) *Attorney, Agent, or Firm* — ExxonMobil Technology and Engineering Company—Law Department

(57) ABSTRACT

A method for controlling the growth of a hydraulic fracture using a stress shadow generated during a hydraulic fracturing operation includes selecting a stage pair including a first stage and a second stage for which hydraulic fractures are to be generated via a hydraulic fracturing operation. The method also includes hydraulic fracturing the first stage to generate a corresponding first hydraulic fracture and controlling a magnitude of a stress shadow originating from the first hydraulic fracture by varying at least one parameter of the hydraulic fracturing operation, where the stress shadow is controlled so as to provide a second hydraulic fracture of a target fracture shape for the second stage. The method further includes hydraulic fracturing the second stage to generate the second hydraulic fracture with the target fracture shape.

24 Claims, 8 Drawing Sheets

(56) References Cited

U.S. PATENT DOCUMENTS

| | | | | |
|---|---|---|---|---|
| 9,988,895 | B2 * | 6/2018 | Roussel | E21B 47/06 |
| 10,132,147 | B2 * | 11/2018 | Safariforoshani | E21B 43/26 |
| 10,253,598 | B2 * | 4/2019 | Crews | E21B 43/17 |
| 10,392,913 | B2 * | 8/2019 | Wilson | G01H 9/004 |
| 10,422,208 | B2 * | 9/2019 | Weng | E21B 43/267 |
| 10,669,832 | B2 * | 6/2020 | Dawson | E21B 47/06 |
| 10,788,604 | B2 * | 9/2020 | Garcia-Teijeiro | G01V 20/00 |
| 10,995,609 | B2 * | 5/2021 | Felkl | E21B 47/117 |
| 11,215,722 | B2 * | 1/2022 | Le Calvez | G01V 1/52 |
| 11,274,538 | B2 * | 3/2022 | Mohamed | E21B 43/16 |
| 11,384,284 | B2 * | 7/2022 | Hahn | E21B 43/26 |
| 11,542,801 | B2 * | 1/2023 | Chen | E21B 33/13 |
| 11,734,479 | B2 * | 8/2023 | Zhang | E21B 41/00 703/10 |
| 11,840,910 | B2 * | 12/2023 | Kishida | E21B 43/26 |
| 11,846,172 | B1 * | 12/2023 | Fraim | E21B 47/0224 |
| 11,892,579 | B2 * | 2/2024 | Hogarth | G01V 1/282 |
| 2016/0201447 | A1 * | 7/2016 | Hoversten | E21B 49/00 702/7 |
| 2017/0247995 | A1 * | 8/2017 | Crews | E21B 41/0035 |
| 2018/0258760 | A1 * | 9/2018 | Kashikar | E21B 43/26 |
| 2018/0283153 | A1 * | 10/2018 | Crews | E21B 43/305 |
| 2019/0128110 | A1 * | 5/2019 | Spicer | E21B 43/26 |
| 2019/0218898 | A1 * | 7/2019 | Semenov | E21B 47/11 |
| 2021/0270113 | A1 * | 9/2021 | Sovizi | E21B 43/26 |
| 2022/0243573 | A1 * | 8/2022 | Rall | B01F 35/712 |
| 2023/0003119 | A1 * | 1/2023 | Jin | E21B 49/00 |
| 2023/0075327 | A1 * | 3/2023 | Mishra | G01V 11/00 |
| 2023/0084576 | A1 * | 3/2023 | Hahn | C09K 8/94 |
| 2023/0183562 | A1 * | 6/2023 | Morsy | E21B 43/166 |
| 2024/0110472 | A1 * | 4/2024 | Xia | E21B 43/26 |
| 2024/0229630 | A1 * | 7/2024 | Manchanda | E21B 43/30 |
| 2024/0240556 | A1 * | 7/2024 | Narhi | E21B 49/00 |
| 2024/0410262 | A1 * | 12/2024 | Narhi | E21B 43/17 |

* cited by examiner

700

CONTROLLING HYDRAULIC FRACTURE GROWTH USING STRESS SHADOWS

CROSS-REFERENCE TO RELATED APPLICATION

This application claims priority to and the benefit of U.S. Provisional Application No. 63/506,998, entitled "Controlling Hydraulic Fracture Growth Using Stress Shadows," having a filing date of Jun. 8, 2023, the disclosure of which is incorporated herein by reference in its entirety.

FIELD OF THE INVENTION

The techniques described herein relate generally to the field of hydrocarbon well completions and hydraulic fracturing operations. More specifically, the techniques described herein relate to controlling the growth of hydraulic fractures using stress shadows.

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Low-permeability hydrocarbon reservoirs are often stimulated using hydraulic fracturing techniques. Hydraulic fracturing consists of injecting a volume of fracturing fluid through created perforations and into the surrounding reservoir at such high pressures and rates that the reservoir rock in proximity to the perforations cracks open, resulting in the creation of hydraulic fractures that propagate within the formation. A proppant (e.g., typically consisting primarily of sand and/or ceramic beads) is then pumped into the created hydraulic fractures along with the fracturing fluid to hold the hydraulic fractures open after the hydraulic pressure has been released following the hydraulic fracturing operation. In this manner, the created hydraulic fractures provide a long-term increase in fluid permeability within the near-wellbore region of the formation, thus permitting hydrocarbon fluids to flow into the wellbore and then be produced at the surface.

A hydraulic fracturing operation involves dividing the fractured portion of the wellbore into stages, where each stage is stimulated separately, typically starting with the deepest stage (e.g., the toe) and proceeding incrementally to the shallowest stage (e.g., the heel). Each stage has a number of perforation clusters spaced along the length of the stage, and each perforation cluster includes perforations that focus the flow of the fracturing fluid and, thus, induce the creation of a corresponding hydraulic fracture. Therefore, as each stage is stimulated separately, the number of hydraulic fractures created for each stage is generally limited by the number of perforation clusters in the stage.

An integral part of the hydraulic fracture process includes planning the fracture order, or sequencing, with which the wells in a particular pad are fractured. In general, a pad can be fractured according to any suitable fracture order, such as, for example, a top down fracture order (i.e., starting with the shallowest bench well and proceeding incrementally to the deepest bench well), a bottom up fracture order (i.e., starting with the deepest bench well and proceeding incrementally to the shallowest bench well), an East to West fracture order, a West to East fracture order, or the like. Regardless of the fracture order, fracturing often commences with the first stage (i.e., the deepest stage) of one well, moves to the first stage (i.e., the deepest stage) of the next well, and then continues with the first stage of each subsequent well in the pad. This is then performed sequentially by incrementing the stage number for each round of fracturing. This is illustrated by Table 1, which includes a portion of a top down fracture order and a portion of a bottom up fracture order for a pad of three wells, with Well B having a greater true vertical depth (TVD) than Well A and Well C having a greater TVD than Well B.

TABLE 1

Fracture Order Options for Pad of Three Wells

| Top Down Fracture Order | Bottom Up Fracture Order |
|---|---|
| Well A - Stage 1 | Well C - Stage 1 |
| Well B - Stage 1 | Well B - Stage 1 |
| Well C - Stage 1 | Well A - Stage 1 |
| Well A - Stage 2 | Well C - Stage 2 |
| Well B - Stage 2 | Well B - Stage 2 |
| Well C - Stage 2 | Well A - Stage 2 |

While these fracture order options are commonly employed, hydraulic fracturing according to this type of fracture order often results in the generation of large stress shadows, meaning that a large increase in stress is produced in the vicinity of a created hydraulic fracture (i.e., producing a stress shadow for the hydraulic fracture). When an interacting (e.g., neighboring or adjoining) hydraulic fracture is then created near (e.g., parallel to) the existing open hydraulic fracture within the stress shadow, the newly-created hydraulic fracture has a closure stress that is greater than the original in-situ stress. As a result, the presence of stress shadows often impacts the growth and ultimate shape of newly-created hydraulic fractures. This is illustrated by FIG. 1, which is a simplified schematic view of a well 100 including two hydraulic fractures 102 and 104 with an intervening stress shadow 106. As shown in FIG. 1, the first-created hydraulic fracture 102 creates the stress shadow 106 in the direction of the second-created hydraulic fracture 104, thus impacting the growth of the second-created hydraulic fracture 104.

In some cases, buffers are included in fracture orders, where the term "buffer" refers to the process of altering a standard fracture order such that stages of some wells are fractured ahead of the corresponding stages of other wells in a pad (or neighboring pad). This is illustrated by Table 2, which includes a portion of a top down fracture order with a one-stage buffer for the pad of three wells described above.

TABLE 2

| Top Down Fracture Order Option with One-Stage Buffer |
|---|
| Well A - Stage 1 |
| Well A - Stage 2 |
| Well B - Stage 1 |
| Well A - Stage 3 |
| Well B - Stage 2 |
| Well C - Stage 1 |
| Well A - Stage 4 |
| Well B - Stage 3 |
| Well C - Stage 2 |

In general, the purpose of including such buffers is to increase the amount of time and distance between the creation of hydraulic fractures located in the same vertical plane. This allows more time for the fluid pressure to leak-off into the formation, thus reducing the net pressure within the hydraulic fractures and increasing the distance between the hydraulic fractures. As a result, the sizes of the corresponding stress shadows are also decreased. Conversely, the reduction or elimination of buffers would increase the sizes of the corresponding stress shadows.

However, even when a group of wells are fractured according to a predetermined fracture order, inefficiencies remain in the hydraulic fracturing process. In particular, there is currently not an effective means for controlling the direction of fracture growth since the fracturing fluid will simply follow the path of least resistance through the rock matrix. In some cases, well engineers attempt to leverage matrix properties, such as the fracture gradient, to influence fracture growth. However, according to current techniques, the fracture growth and, thus, the resulting fracture shape, cannot be effectively controlled.

SUMMARY OF THE INVENTION

An embodiment described herein provides a method for controlling the growth of a hydraulic fracture using a stress shadow generated during a hydraulic fracturing operation. The method includes selecting a stage pair including a first stage and a second stage for which hydraulic fractures are to be generated via a hydraulic fracturing operation. The method also includes hydraulic fracturing the first stage to generate a corresponding first hydraulic fracture and controlling a magnitude of a stress shadow originating from the first hydraulic fracture by varying at least one parameter of the hydraulic fracturing operation, where the stress shadow is controlled so as to provide a second hydraulic fracture of a target fracture shape for the second stage. The method further includes hydraulic fracturing the second stage to generate the second hydraulic fracture with the target fracture shape.

Another embodiment described herein provides a hydrocarbon well system. The hydrocarbon well system includes a first well in a first bench and a second well in a second bench. The first bench and the second bench are positioned such that interacting hydraulic fractures can be generated for corresponding stages of the first well and the second well. A first stage of the first well includes a corresponding first hydraulic fracture, and a second stage of the second well includes a second hydraulic fracture of a target fracture shape, where the first hydraulic fracture is generated prior to the second hydraulic fracture, and where a magnitude of a stress shadow originating from the first hydraulic fracture during a corresponding hydraulic fracturing operation is utilized to provide the target fracture shape for the second hydraulic fracture. The hydrocarbon well system also includes a computing system that is communicably coupled to the first well and the second well. The computing system includes a processor and a non-transitory, computer-readable storage medium including program instructions that are executable by the processor to cause the processor to control the magnitude of the stress shadow originating from the first hydraulic fracture by varying at least one parameter of the hydraulic fracturing operation.

These and other features and attributes of the disclosed embodiments of the present techniques and their advantageous applications and/or uses will be apparent from the detailed description that follows.

BRIEF DESCRIPTION OF THE DRAWINGS

To assist those of ordinary skill in the relevant art in making and using the subject matter described herein, reference is made to the appended drawings, where.

Figure 1:
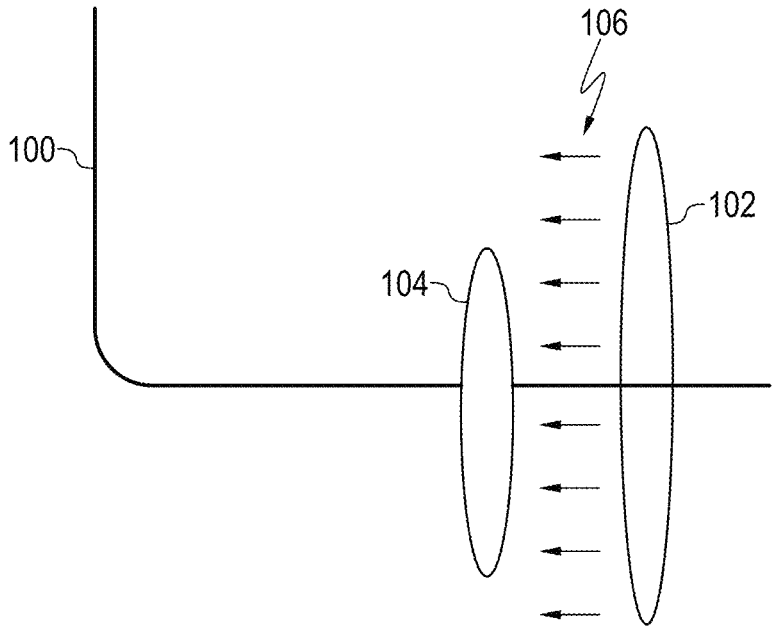
FIG. 1 is a simplified schematic view of a well including two hydraulic fractures with an intervening stress shadow.

It should be noted that the figures are merely examples of the present techniques and are not intended to impose limitations on the scope of the present techniques. Further, the figures are generally not drawn to scale, but are drafted for purposes of convenience and clarity in illustrating various aspects of the techniques.

DETAILED DESCRIPTION OF THE PREFERRED EMBODIMENTS

In the following detailed description section, the specific examples of the present techniques are described in connection with preferred embodiments. However, to the extent that the following description is specific to a particular embodiment or a particular use of the present techniques, this is intended to be for exemplary purposes only and simply provides a description of the embodiments. Accordingly, the techniques are not limited to the specific embodiments described below, but rather, include all alternatives, modifications, and equivalents falling within the true spirit and scope of the appended claims.

At the outset, and for case of reference, certain terms used in this application and their meanings as used in this context are set forth. To the extent a term used herein is not defined below, it should be given the broadest definition those skilled in the art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the singular forms "a," "an," and "the" mean one or more when applied to any embodiment described herein. The use of "a," "an," and/or "the" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the term "any" means one, some, or all of a specified entity or group of entities, indiscriminately of the quantity.

The phrase "at least one," when used in reference to a list of one or more entities (or elements), should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the phrase "based on" does not mean "based only on," unless expressly specified otherwise. In other words, the phrase "based on" means "based only on," "based at least on," and/or "based at least in part on."

As used herein, the term "bench" refers to a target interval or section of a subsurface area that typically shares a substantial number of geologic properties, somewhat analogous to a geological formation.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure, or method is not intended to be limiting, required, or exclusive/exhaustive; and other components, features, structures, or methods, including structurally and/or functionally similar and/or equivalent components, features, structures, or methods, are also within the scope of the present techniques.

The term "fracture" (or "hydraulic fracture") refers to a crack or surface of breakage induced by an applied pressure or stress within a subterranean formation.

The term "hydraulic fracturing" refers to a process for creating hydraulic fractures that extend from a wellbore into a reservoir, so as to stimulate the flow of hydrocarbon fluids from the reservoir into the wellbore. A fracturing fluid is generally injected into the reservoir with sufficient pressure to create and extend multiple fractures within the reservoir, and a proppant material is used to hold open the fractures after the hydraulic pressure used to generate the fractures has been released.

As used herein, the terms "shape," "fracture shape," and "hydraulic fracture shape," when used with reference to a hydraulic fracture, refer to the three-dimensional geometry of the hydraulic fracture. Moreover, it is to be understood that the terms "target shape," "target fracture shape," and "target hydraulic fracture shape" refer to a desired approximate three-dimensional geometry of the hydraulic fracture, not an exact three-dimensional geometry (i.e., allowing for reasonable, realistic variation from the desired three-dimensional geometry based on the real-world conditions within the subsurface region).

As used herein, the term "stress shadow," when used with reference to a hydraulic fracture, refers to an induced stress field around the hydraulic fracture. This induced stress field may result in stress interference for any interacting hydraulic fractures, which can impact the growth and geometry of such interacting hydraulic fractures.

The term "wellbore" refers to a borehole drilled into a subterranean formation. The borehole may include vertical, deviated, highly deviated, and/or horizontal sections. The term "wellbore" also includes the downhole equipment associated with the borehole, such as the casing strings, production tubing, gas lift valves, and other subsurface equipment. Relatedly, the term "hydrocarbon well" (or simply "well") includes the wellbore in addition to the wellhead and other associated surface equipment.

The term "hydrocarbon well system" is used herein to refer to any suitable combination of hydrocarbon wells and associated equipment within a particular field of interest. More specifically, according to embodiments described herein, a hydrocarbon well system includes at least one hydrocarbon well (with the corresponding wellhead, wellbore, and associated downhole and surface equipment), but will often include wells from multiple benches within a pad. In addition, according to embodiments described herein, the hydrocarbon well system may include at least one computing system that enables the direction and execution of various hydrocarbon development tasks with respect to such well(s), including, for example, completion, stimulation, and production-related tasks.

Turning now to details of the present techniques, as described above, there is currently not an effective means for controlling the direction of fracture growth and, thus, impacting the ultimate fracture shape during hydraulic fracturing operations. Accordingly, the present techniques alleviate this difficulty and provide related advantages as well. In particular, the techniques described herein enable the growth of hydraulic fractures to be controlled using stress shadows. In other words, the present techniques relate to leveraging the stress shadow(s) created by one or more hydraulic fractures to achieve a target fracture shape for a subsequent hydraulic fracture during a hydraulic fracturing operation. This is accomplished by selectively varying one or more parameters of the hydraulic fracturing operation to provide stress shadow(s) of a predetermined magnitude (where the term "predetermined magnitude" as used herein is understood to mean an approximate size, intensity, dimension, and/or shape for a corresponding stress shadow). Such variable parameters may include, but are not limited to, the number of stage buffers, the well spacing (i.e., lateral distance between wells), the well stacking (i.e., vertical distance between wells), the fracture order (e.g., bottom up, top down, East to West, West to East, or the like), the time between the fracturing of stages, the stage spacing, the cluster spacing, the cluster orientation, the number of clusters per stage, the pad design, the number of fracture crews per development, the fracture plug design, the pressure in interacting wells, and/or the fracturing fluid design (e.g., the viscosity, sand concentration, fluid volume, proppant volume, proppant type, proppant size, near and far field diverters, and/or pump rate). As more specific, non-limiting examples, in order to achieve stress shadow(s) of the desired magnitude(s), stage buffers may be varied (e.g., reduced or eliminated), the time between the fracturing of stages may be varied (e.g., reduced), the cluster spacing may be varied (e.g., reduced), the stage spacing may be varied (e.g., reduced), and/or any number of other relevant variables may be altered during the hydraulic fracturing operation. In this manner, the magnitude(s) of the stress shadow(s) may be specifically engineered to achieve target fracture shape(s) for one or more newly-created hydraulic fractures. Moreover, in some embodiments, the magnitude(s) of the stress shadow(s) are effectively monitored based on the measured internal shut-in pressure(s) (ISIPs) corresponding to the well(s). This may provide a real-time measurement that enables the operator to determine whether additional parameters should be varied to further control the magnitude(s) of the stress shadow(s).

Figure 2A:
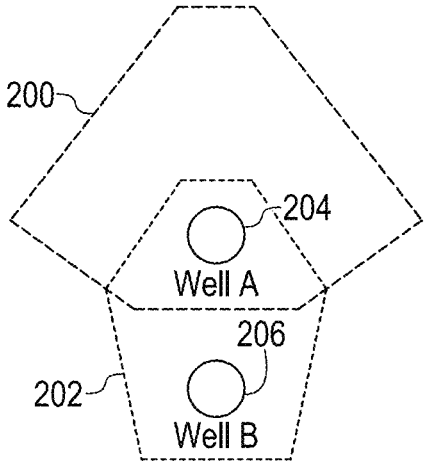
FIG. 2A is a simplified schematic view of interacting hydraulic fractures for corresponding stages of two wells, Well A and Well B, for a first case in which the hydraulic fracture corresponding to the stage of Well A does not include a significant stress shadow during the subsequent creation of the hydraulic fracture corresponding to the stage of Well B.
Figure 2B:
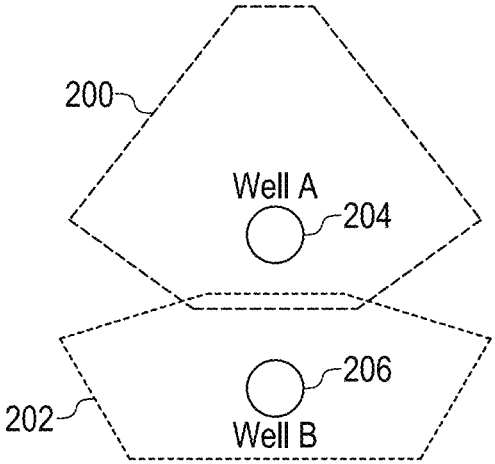
FIG. 2B is a simplified schematic view of the interacting hydraulic fractures for the corresponding stages of the two wells for a second case in which the hydraulic fracture corresponding to the stage of Well A does include a significant stress shadow during the creation of the hydraulic fracture corresponding to the stage of Well B.

This is illustrated by FIGS. 2A and 2B. Specifically, FIG. 2A is a simplified schematic view of interacting hydraulic fractures 200 and 202 for corresponding stages 204 and 206 of two wells, Well A and Well B, respectively, for a first case in which the hydraulic fracture 200 corresponding to the stage 204 of Well A does not include a significant stress shadow during the subsequent creation of the hydraulic fracture 202 corresponding to the stage 206 of Well B, while FIG. 2B is a simplified schematic view of the interacting hydraulic fractures 200 and 202 for the corresponding stages 204 and 206 of the two wells for a second case in which the hydraulic fracture 200 corresponding to the stage 204 of Well A does include a significant stress shadow during the creation of the hydraulic fracture 202 corresponding to the stage 206 of Well B. First considering the scenario of FIG. 2A, the fracturing plan for the hydraulic fracturing operation includes stage buffers (and/or any number of other suitable parameter settings) such that there is no appreciable stress shadow emanating from the hydraulic fracture 200 corresponding to the stage 204 of Well A by the time the hydraulic fracture 202 corresponding to the stage 206 of Well B is created. As a result, the hydraulic fracture 202 corresponding to the stage 206 of Well B naturally grows vertically, as shown in FIG. 2A. Now considering the scenario of FIG. 2B, the fracturing plan does not include stage buffers (or other suitable parameter settings that would minimize the generated stress shadow), and the hydraulic fracture 202 corresponding to the stage 206 of Well B is created quickly after the hydraulic fracturing of the stage 204 of Well A. Because there is such a short time interval between the fracturing of the two stages 204 and 206, the fluid pressure in the hydraulic fracture 200 corresponding to the stage 204 of Well A is still high and fracture closure is minimized when the stage 206 of Well B is hydraulic fractured. Due to such high fluid pressure and minimal fracture closure, a significant stress shadow originates from the hydraulic fracture 200 corresponding to the stage 204 of Well A, and such stress shadow extends at least partially in the direction of the interacting stage 206 of Well B. As a result, when the stage 206 of Well B is hydraulic fractured, the fracturing fluid follows the path of least resistance and travels out and around the stress shadow, resulting in the fracture shape shown in FIG. 2B.

Figure 3A:
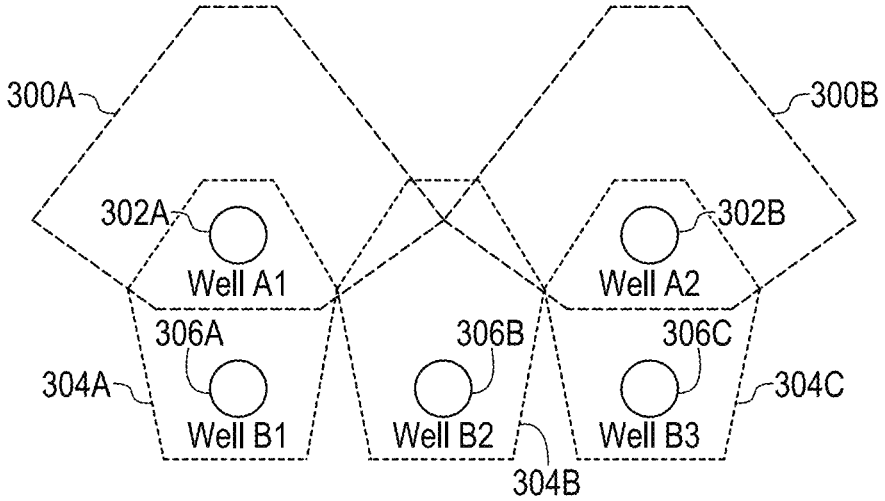
FIG. 3A is a simplified schematic view of multiple interacting hydraulic fractures, including hydraulic fractures corresponding to a stage of Well A1 and a stage of Well A2, respectively, and hydraulic fractures corresponding to a stage of Well B1, a stage of Well B2, and a stage of Well B3, respectively, for a first case in which the hydraulic fractures corresponding to the stages of Well A1 and Well A2 do not include significant stress shadows during the subsequent creation of the hydraulic fractures corresponding to the stages of Well B1, Well B2, and Well B3.
Figure 3B:
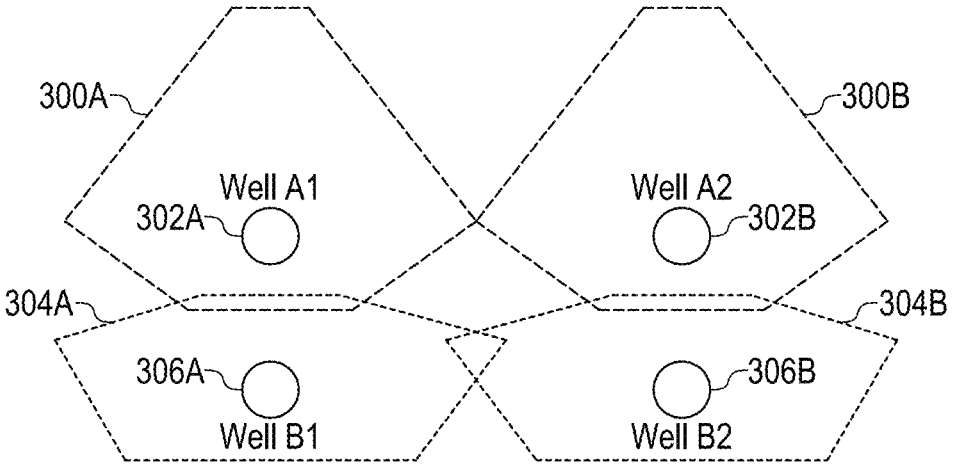
FIG. 3B is a simplified schematic view of the multiple interacting hydraulic fractures for a second case in which the hydraulic fractures corresponding to the stages Well A1 and Well A2 do include significant stress shadows during the creation of the hydraulic fractures corresponding to the stages of Well B1 and Well B2.

Moreover, FIGS. 3A and 3B depict more complex scenarios in which more than two hydraulic fractures interact during the hydraulic fracturing of stages of multiple wells (i.e., Wells A1, A2, B1, B2, and B3). Specifically, FIG. 3A is a simplified schematic view of multiple interacting hydraulic fractures, including hydraulic fractures 300A and 300B corresponding to a stage of Well A1 302A and a stage of Well A2 302B, respectively, and hydraulic fractures 304A, 304B, and 304C corresponding to a stage of Well B1 306A, a stage of Well B2 306B, and a stage of Well B3 306C, respectively, for a first case in which the hydraulic fractures 300A and 300B corresponding to the stages of Well A1 302A and Well A2 302B do not include significant stress shadows during the subsequent creation of the hydraulic fractures 304A, 304B, and 304C corresponding to the stages of Well B1 306A, Well B2 306B, and Well B3 306C. On the other hand, FIG. 3B is a simplified schematic view of the multiple interacting hydraulic fractures 300A, 300B, 304A, and 304B for a second case in which the hydraulic fractures 300A and 300B corresponding to the stages Well A1 302A and Well A2 302B do include significant stress shadows during the creation of the hydraulic fractures 304A and 304B corresponding to the stages of Well B1 306A and Well B2 306B.

Considering the scenario of FIG. 3A (similarly to the scenario of FIG. 2A), the fracturing plan for the hydraulic fracturing operation includes stage buffers (and/or any number of other suitable parameter settings) such that there is no appreciable stress shadow emanating from the hydraulic fractures 300A and 300B corresponding to the stages of Well A1 302A and Well A2 302B by the time the hydraulic fractures 304A, 304B, and 304C corresponding to the stages of Well B1 306A, Well B2 306B, and Well B3 306C are created. As a result, the hydraulic fractures 304A, 304B, and 304C corresponding to the stages of Well B1 306A, Well B2 306B, and Well B3 306C naturally grow vertically, as shown in FIG. 3A. Now considering the scenario of FIG. 3B (similarly to the scenario of FIG. 2B), the fracturing plan does not include stage buffers (or other suitable parameter settings that would minimize the generated stress shadow), and the hydraulic fractures 304A and 304B corresponding to the stages of Well B1 306A and Well B2 306B are created quickly after the hydraulic fracturing of the stages of Well A1 302A and Well A2 302B. Because there is such a short time interval between the fracturing of the stages of the wells 302A, 302B, 306A, and 306B, the fluid pressure in the hydraulic fractures 300A and 300B corresponding to the stages of Well A1 302A and Well A2 302B is still high and fracture closure is minimized when the stages of Well B1 306A and Well B2 306B are hydraulic fractured. Due to such high fluid pressure and minimal fracture closure, significant stress shadows originate from the hydraulic fractures 300A and 300B corresponding to the stages of Well A1 302A and Well A2 302B, and such stress shadows extend at least partially in the direction of the interacting stages of Well B1 306A and Well B2 306B. As a result, when the stages of Well B1 306A and Well B2 306B are hydraulic fractured, the fracturing fluid follows the path of least resistance and travels out and around the stress shadows, resulting in the fracture shapes shown in FIG. 3B.

Those skilled in the art will appreciate that FIGS. 2A, 2B, 3A, and 3B depict simplified scenarios in which the generation of a stress shadow within a single stage of each well is sufficient to direct the fracture growth within a stage of another well. However, in operation, stress shadows originating from multiple stages of each well may be utilized to effectively direct the fracture growth within a stage of another well. As an example, stress shadows originating from two or more stages of Well A may be utilized to force a hydraulic fracture corresponding to a single stage of Well B to grow in one or more desired directions.

Figure 4:
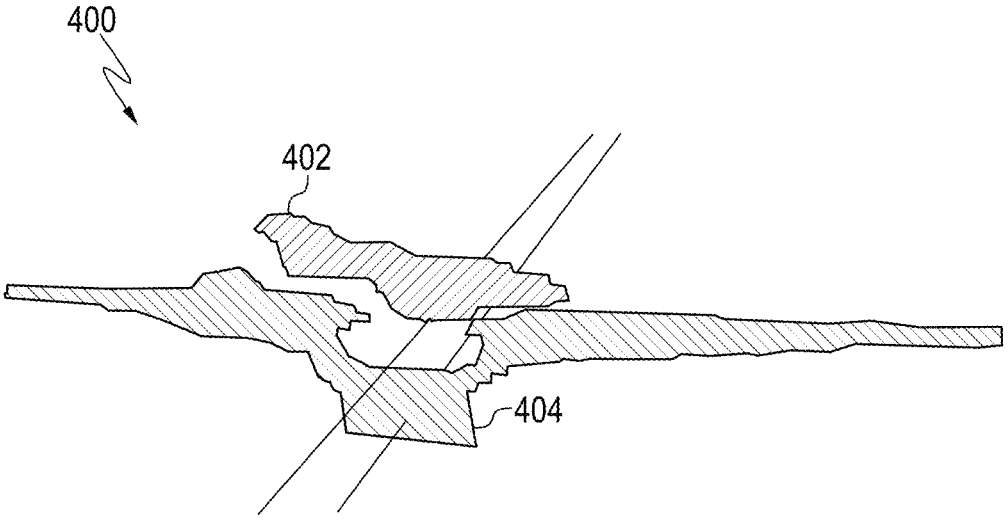
FIG. 4 is a schematic view of a model of two interacting hydraulic fractures generated using fracture simulation software.

This is further illustrated by FIG. 4, which is a schematic view of a model 400 of two interacting hydraulic fractures 402 and 404 generated using fracture simulation software. The model 400 depicts the manner in which the stress shadow originating from the upper hydraulic fracture 402 inhibits the upward growth of the lower hydraulic fracture 404. Accordingly, changes in the stress shadow for the upper hydraulic fracture 402 would impact the growth (e.g., in particular, the height growth) of the lower hydraulic fracture 404. For example, increasing the magnitude of the stress shadow would further inhibit the height growth of the lower hydraulic fracture 404 (by forcing the lower hydraulic fracture 404 to grow directionally around or away from the stress shadow for the upper hydraulic fracture 402), while decreasing the magnitude of the stress shadow would allow for greater height growth of the lower hydraulic fracture 404.

According to embodiments described herein, various parameters of the hydraulic fracturing operation may be altered or varied to control the stress shadow(s) corresponding to one or more hydraulic fractures, thus achieving target fracture shape(s) for one or more interacting hydraulic fractures and maximizing the conductive area(s) of such interacting hydraulic fracture(s). Such variable parameters may include, but are not limited to, the number of stage buffers, the well spacing (i.e., lateral distance between wells), the well stacking (i.e., vertical distance between wells), the fracture order (i.e., bottom up or top down), the time between the fracturing of stages, the stage spacing, the cluster spacing, the cluster orientation, the number of clusters per stage, the pad design, the number of fracture crews per development, the fracture plug design, the pressure in interacting wells, and/or the fracturing fluid design (e.g., the viscosity, sand concentration, fluid volume, proppant volume, proppant type, proppant size, near and far field diverters, and/or pump rate).

As a more specific example of the manner in which the present techniques may be used to control the fracture shape of a hydraulic fracture, assume that it is desirable to drain a reservoir that extends primarily to the cast of a particular well. In this case, one or more hydraulic fractures may be created on the west, and the parameters for the hydraulic fracturing operation may be controlled to provide a large stress shadow on the west. As a result, when the new hydraulic fracture is created to the cast, the stress shadow will force such hydraulic fracture to grow primarily further to the cast, enabling the reservoir of interest to be effectively drained. Moreover, those skilled in the art will appreciate that this approach may be equally applied to direct fracture growth to the west, north, south, upwards, downwards, or in any other desired direction. Furthermore, in some embodiments, stress shadows may be generated on multiple sides of a new hydraulic fracture, thus enabling the resulting fracture shape to be more tightly controlled. For example, multiple stress shadows may be created with respect to wells from multiple pads, and the created stress shadows may be utilized to cumulatively push the fracturing fluid for a new hydraulic fracture into one or more desired directions.

The present techniques may be applied to any suitable combination (or combinations) of stages that are capable of including interacting hydraulic fractures. As an example, the present techniques may be applied to stages corresponding to multiple wells within adjoining benches in a pad. As another example, the present techniques may be applied to multiple stages of a single well. As another example, the present techniques may be applied to stages corresponding to a parent well and a child well (i.e., a parent-child well pair). For example, the direction of fracture growth in the child well may be influenced by increasing the pressure in the parent well to induce a temporary stress shadow while the child well is being hydraulic fractured.

According to embodiments described herein, the target fracture shape may be determined in any suitable manner. For example, in various embodiments, the target fracture shape is determined via a numerical model or fracture simulation that is capable of estimating the fracture shape that is most likely to maximize the propped area without overlap, thus ensuring efficient drainage of the reservoir. In some embodiments, the numerical model or fracture simulation may employ net pay maps and/or data from previous production operations in the same area (or a similar area) when making this determination. Moreover, in some such embodiments, one or more machine learning models may also be utilized to provide insight on the relationship between fracture net pressure and the degree of fracture turning, and such information may be utilized to further inform the output from the numerical model or fracture simulation.

In various embodiments, fracture diagnostic techniques and/or fracture modeling techniques are used to determine whether the stress shadow has been controlled such that the target fracture shape can be achieved. As an example of such fracture diagnostic techniques, the well(s) from which the relevant stress shadow(s) originate may be monitored using pressure gauges, fiber optic cables, and/or tracers. The collected pressure data, fiber data, and/or tracer data, respectively, may then be utilized to determine whether a suitable stress shadow has been created. In addition, as an example of such fracture modeling techniques, fracture simulation software may be utilized to determine the manner in which varying different parameters for the hydraulic fracturing operation will affect the magnitude(s) of the resulting stress shadow(s).

In various embodiments, the fracturing plan for the hydraulic fracturing operation (including, for example, details relating to well stacking and/or well spacing) may be informed and optimized based on the effective control of the hydraulic fracture shape(s) corresponding to the wells within a pad. For example, taking FIGS. 2B and 3B as an example, hydraulic fractures created under the influence of a higher magnitude stress shadow have far less overlap, allowing such hydraulic fractures to drain hydrocarbons from a wider area within the corresponding bench with little to no competition. This could be used to increase the efficiency in draining a cube development, for example, and would also increase the overall production for the wells. Furthermore, if this concept were duplicated on neighboring pads, an arrangement of wells could be devised such that the well spacing in a second bench, for example, would include fewer wells when utilizing stress shadows to push the hydraulic fractures in desired directions while still providing similar drainage of the overall cube development.

The present techniques provide various advantages over conventional hydraulic fracturing techniques. As an example, the present techniques enable fracture shapes to be specifically engineered based on expected and/or known conditions within the relevant subsurface region, thus enhancing the recovery of hydrocarbon resources from such subsurface region. As another example, the present techniques provide for the effective control (or constraint) of the height growth of hydraulic fractures, particularly in benches where upward growth limits are preferred. As another example, the present techniques provide for the effective implementation of well stacking and/or spacing plans via the control of fracture shape, which is particularly beneficial for unconventional plays that are more difficult to effectively drain. As another example, the present techniques allow difficult-to-reach resources to be effectively produced as a result of the specifically engineered fracture shapes. This is in contrast to conventional stimulation techniques, in which such difficult-to-reach resources are generally left behind due to the inefficient fracture shapes.

Figure 5:
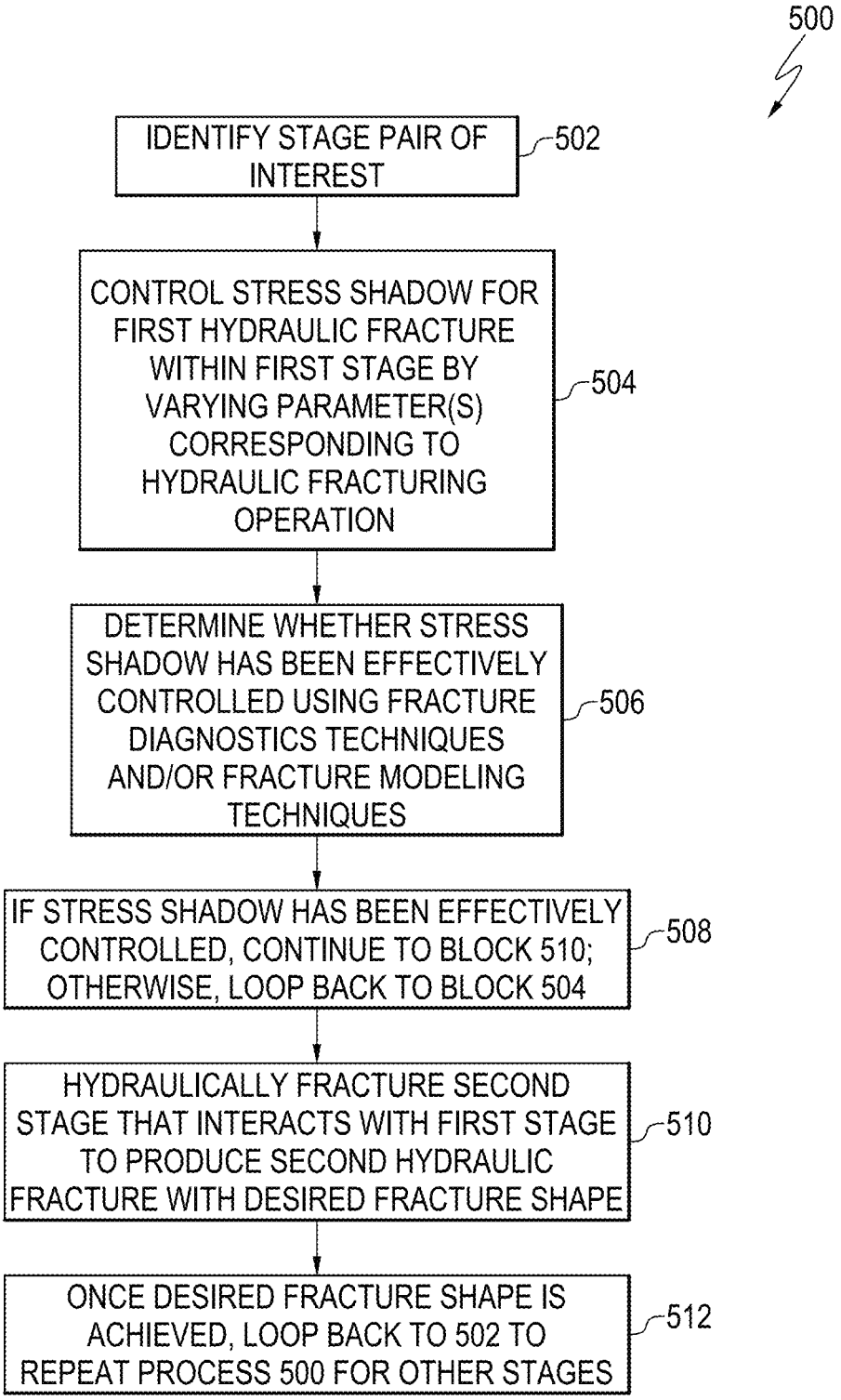
FIG. 5 is a process flow diagram of an exemplary process for leveraging the stress shadow(s) created by one or more hydraulic fractures to achieve a target fracture shape for a subsequently-created hydraulic fracture during a hydraulic fracturing operation, in accordance with the present techniques.

FIG. 5 is a process flow diagram of an exemplary process 500 for leveraging the stress shadow(s) created by one or more hydraulic fractures to achieve a target fracture shape for a subsequently-created hydraulic fracture during a hydraulic fracturing operation, in accordance with the present techniques. The process 500 may be executed, in part, by one or more computing systems including one or more processors, such as the exemplary cluster computing system described with respect to FIG. 7 (or any suitable variation(s) thereof). In some embodiments, such computing system(s) are positioned at the hydrocarbon field at which the relevant well(s) are located and form part of the overall hydrocarbon well system. For example, the computing system(s) may form part of a mobile command center for directing the operations performed with respect to such well(s).

The exemplary process 500 begins at block 502, at which a stage pair of interest is identified. Such stage pair may include corresponding stages from two wells within adjoining benches, adjoining stages of a single well, corresponding stages from a parent-child well pair, or any other combination of stages that are positioned such that interacting hydraulic fractures can be created.

At block 504, the stress shadow corresponding to the first hydraulic fracture created with respect to the first stage of the stage pair is controlled by varying one or more parameters corresponding to the hydraulic fracturing operation. Such variable parameters may include, but are not limited to, the number of stage buffers, the well spacing, the well stacking, the fracture order, the time between the fracturing of stages, the stage spacing, the cluster spacing, the cluster orientation, the number of clusters per stage, the pad design, the number of fracture crews per development, the fracture plug design, the pressure in interacting wells, and/or the fracturing fluid design, as described herein. As non-limiting examples, varying such parameter(s) at block 504 may include reducing or eliminating stage buffers, reducing the time between the fracturing of the two stages, reducing the cluster spacing, reducing the distance between the stages, and/or altering one or more other relevant variables. More generally speaking, the variation of parameters that are dependent on time is targeted towards reducing the time between the creation of the active fracture and the prior fracture, thereby limiting the amount of time for pressure leak-off in the prior fracture and maintaining a high stress shadow effect. In contrast, the variation of parameters that are dependent on distance is targeted towards increasing the stress shadow effect by reducing the distance between the prior fracture and the active fracture, thereby increasing the stress shadow effect on the active fracture.

At block 506, it is then determined whether the stress shadow has been effectively controlled using fracture diagnostic techniques and/or fracture modeling techniques, as described herein. At block 508, if it has been determined that the stress shadow has been effectively controlled, the process 500 proceeds to block 510; otherwise, the process 500 loops back to block 504.

Proceeding to block 510, the second stage of the stage pair is hydraulic fractured to produce a second hydraulic fracture with a target fracture shape, where such target fracture shape is achieved (at least in part) via the control of the stress shadow at block 504. Furthermore, at block 512, once the target fracture shape has been achieved, the process 500 may loop back to block 502 to be repeated for another stage pair.

Those skilled in the art will appreciate that the exemplary process 500 of FIG. 5 is susceptible to modification without altering the technical effect provided by the present techniques. In practice, the exact manner in which the process 500 is implemented will depend, at least in part, on the details of the specific implementation. For example, in some embodiments, some of the blocks shown in FIG. 5 may be altered or omitted from the process 500, and/or new blocks may be added to the process 500, without departing from the scope of the present techniques.

Figure 6:
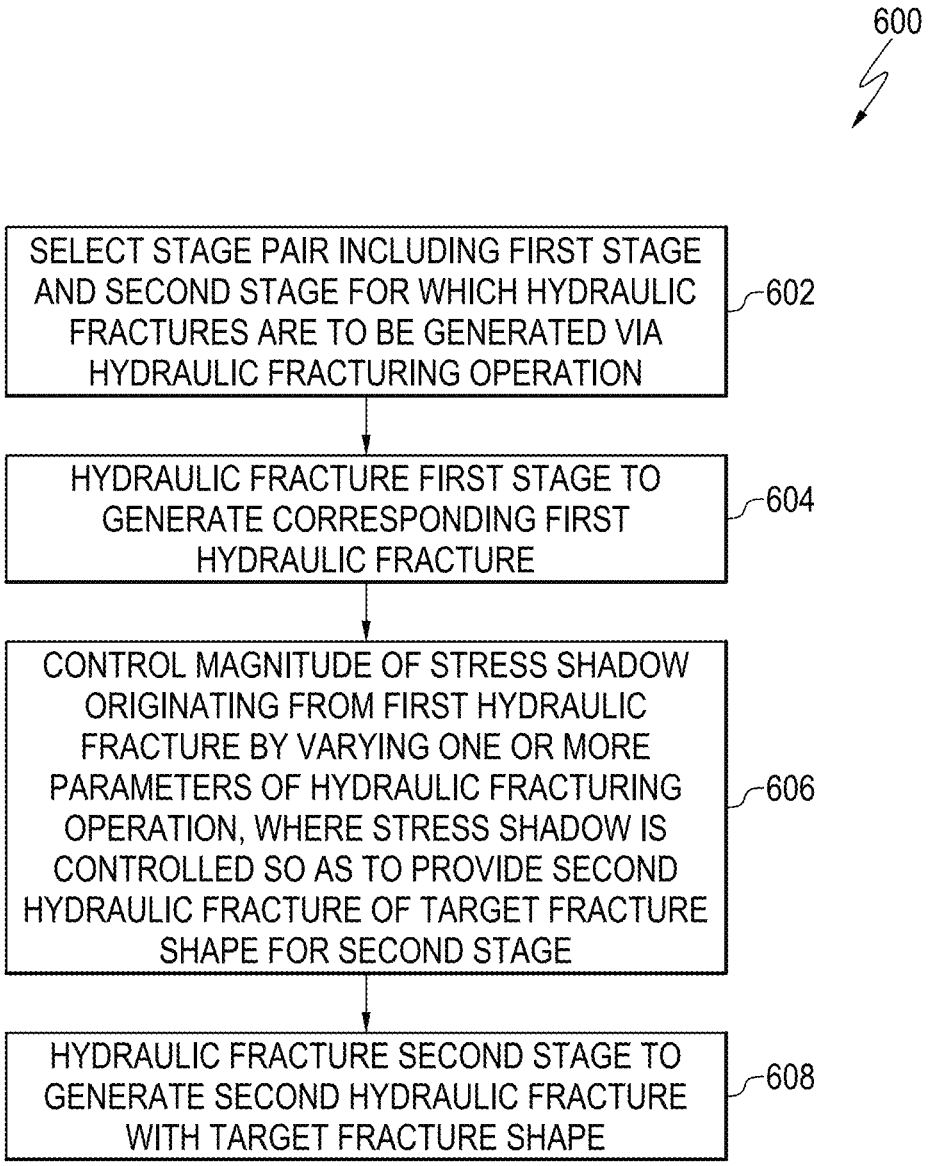
FIG. 6 is a process flow diagram of an exemplary method for controlling the growth of hydraulic fractures using stress shadows, in accordance with the present techniques.

FIG. 6 is a process flow diagram of an exemplary method 600 for controlling the growth of hydraulic fractures using stress shadows, in accordance with the present techniques. The method 600 may be executed, in part, by one or more computing systems including one or more processors, such as the exemplary cluster computing system described with respect to FIG. 7 (or any suitable variation(s) thereof). In some embodiments, such computing system(s) are positioned at the hydrocarbon field at which the relevant well(s) are located and form part of the overall hydrocarbon well system. For example, the computing system(s) may form part of a mobile command center for directing the operations performed with respect to such well(s).

The method 600 begins at block 602, at which a stage pair is selected, where the stage pair includes a first stage and a second stage for which hydraulic fractures are to be generated via a hydraulic fracturing operation. In some embodiments, this includes selecting a stage of a first well as the first stage and selecting a corresponding stage of a second well in an adjoining bench as the second stage. In other embodiments, this includes selecting a stage of a parent well as the first stage and selecting a corresponding stage of a child well as the second stage. In yet other embodiments, this includes selecting adjoining stages of a single well as the first stage and the second stage. Moreover, it should be noted that, according to embodiments described herein, references to a single stage of a first or parent well are intended to be non-limiting and may include any or all stages of such well, depending on the details of the particular implementation. As an example, for embodiments in which there is no separation (e.g., frac plugs) between the stages of the well, references to a single stage may be construed to include all stages of the well.

At block 604, the first stage is hydraulic fractured to generate a corresponding first hydraulic fracture. At block 606, the magnitude of a stress shadow originating from the first hydraulic fracture is controlled by varying one or more parameters of the hydraulic fracturing operation, where the stress shadow is controlled so as to provide a second hydraulic fracture of a target fracture shape for the second stage. In various embodiments, such parameter(s) include one or more of: (a) the number of stage buffers, (b) the well spacing, (c) the well stacking, (d) the fracture order, (c) the time between the hydraulic fracturing of the first stage and the second stage, (f) the stage spacing, (g) the cluster spacing, (h) the cluster orientation, (i) the number of clusters per stage, (j) the pad design, (k) the number of fracture crews per development, (l) the fracture plug design, (m) the pressure in one or more interacting wells, or (n) the fracturing fluid design. Moreover, in some embodiments, the target fracture shape for the second hydraulic fracture is predetermined based (at least in part) on one or more net pay maps and/or data from one or more previous production operations.

At block 608, the second stage is hydraulic fractured to generate the second hydraulic fracture with the target fracture shape. Moreover, in some embodiments, the method 600 also includes, prior to the hydraulic fracturing of the second stage at block 608, assessing the magnitude of the stress shadow using fracture diagnostics and/or fracture modeling and, if the magnitude of the stress shadow has not been effectively controlled, varying one or more other parameters of the hydraulic fracturing operation prior to the hydraulic fracturing of the second stage.

In some embodiments, the first stage is positioned at least partially above the second stage, and the target fracture shape includes a large lateral dimension to cover a wider area within a corresponding bench. In such embodiments, controlling the magnitude of the stress shadow originating from the first hydraulic fracture by varying the parameter(s) of the hydraulic fracturing operation may include setting the parameter(s) such that a higher magnitude stress shadow is achieved so as to generate the second hydraulic fracture in a primarily lateral direction. In other embodiments, the first stage is positioned at least partially to one side of the second stage, and the target fracture shape includes a large vertical dimension. In such embodiments, controlling the magnitude of the stress shadow originating from the first hydraulic fracture by varying the parameter(s) of the hydraulic fracturing operation may include setting the parameter(s) such that a higher magnitude stress shadow is achieved so as to generate the second hydraulic fracture in a primarily vertical direction. Furthermore, for embodiments in which the first stage and the second stage correspond to a parent well and a child well, respectively, controlling the magnitude of the stress shadow originating from the first hydraulic fracture for the first stage may include increasing the pressure in the parent well to temporarily increase the magnitude of the stress shadow originating from the first hydraulic fracture while the second stage is hydraulically fractured.

In various embodiments, the method 600 is executed for a number of stage pairs to generate a number of corresponding hydraulic fractures with target fracture shapes. In such embodiments, the method 600 may also include generating a modified well spacing plan for a field in which the wells corresponding to the stage pairs are located, where the modified well spacing plan includes fewer wells than an original well spacing plan, as well implementing the modified well spacing plan in the field, where the modified well spacing plan results in a substantially similar amount of hydrocarbon production as compared to the original well spacing plan. Additionally or alternatively, in such embodiments, the method 600 may include generating a modified completion plan for one or more drilled but uncompleted wells that are located in the field in which the wells corresponding to the stage pairs are located, where the modified completion plan includes a lower fracturing fluid utilization than an original completion plan, as well as implementing the modified completion plan in the field, where the modified completion plan results in a substantially similar amount of hydrocarbon production as compared to the original completion plan.

In various embodiments, the method 600 is executed for a group of stages including one or more additional stages, in addition to the first stage and the second stage. In such embodiments, the one or more additional stages may also be hydraulic fractured to generate corresponding hydraulic fracture(s). The magnitudes of the stress shadows originating from the first hydraulic fracture and the additional hydraulic fracture(s) are then controlled by varying one or more parameters of the hydraulic fracturing operation, where the stress shadows are controlled so as to provide the second hydraulic fracture with the target fracture shape.

Those skilled in the art will appreciate that the exemplary method 600 of FIG. 6 is susceptible to modification without altering the technical effect provided by the present techniques. In practice, the exact manner in which the method 600 is implemented will depend, at least in part, on the details of the specific implementation. For example, in some embodiments, some of the blocks shown in FIG. 6 may be altered or omitted from the method 600, and/or new blocks may be added to the method 600, without departing from the scope of the present techniques.

Figure 7:
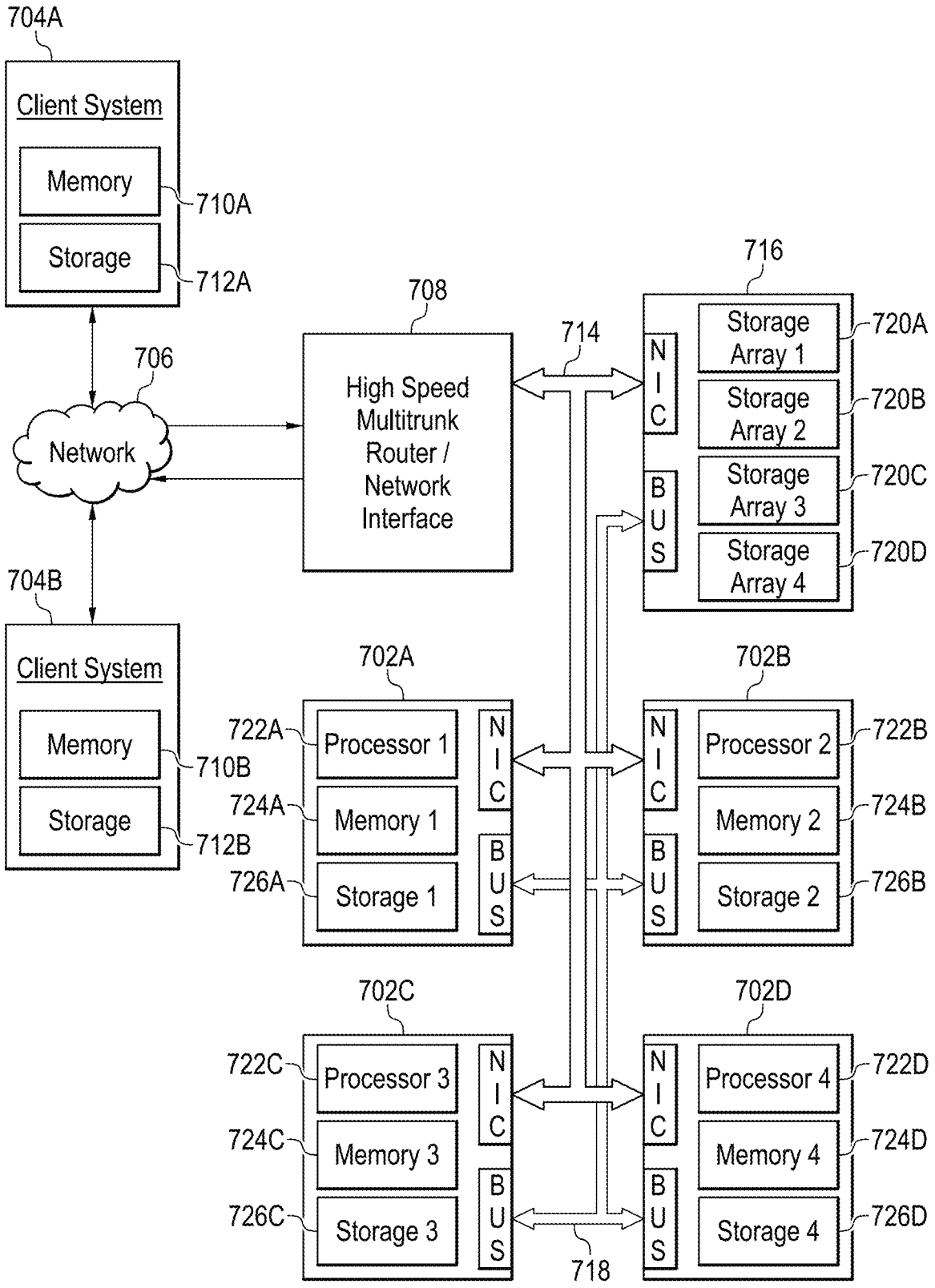
FIG. 7 is a block diagram of an exemplary cluster computing system that may be utilized to implement at least a portion of the present techniques.

FIG. 7 is a block diagram of an exemplary cluster computing system 700 that may be utilized to implement at least a portion of the present techniques. The exemplary cluster computing system 700 shown in FIG. 7 has four computing units 702A, 702B, 702C, and 702D, each of which may perform calculations for a portion of the present techniques. However, one of ordinary skill in the art will recognize that the cluster computing system 700 is not limited to this configuration, as any number of computing configurations may be selected. For example, a smaller analysis may be run on a single computing unit, such as a workstation, while a large calculation may be run on a cluster computing system 700 having tens, hundreds, or even more computing units.

The cluster computing system 700 may be accessed from any number of client systems 704A and 704B over a network 706, for example, through a high-speed network interface 708. The computing units 702A to 702D may also function as client systems, providing both local computing support and access to the wider cluster computing system 700.

The network 706 may include a local area network (LAN), a wide area network (WAN), the Internet, or any combinations thereof. Each client system 704A and 704B may include one or more non-transitory, computer-readable storage media for storing the operating code and program instructions that are used to implement at least a portion of the present techniques, as described further with respect to the non-transitory, computer-readable storage media of FIG. 8. For example, each client system 704A and 704B may include a memory device 710A and 710B, which may include random access memory (RAM), read only memory (ROM), and the like. Each client system 704A and 704B may also include a storage device 712A and 712B, which may include any number of hard drives, optical drives, flash drives, or the like.

The high-speed network interface 708 may be coupled to one or more buses in the cluster computing system 700, such as a communications bus 714. The communication bus 714 may be used to communicate instructions and data from the high-speed network interface 708 to a cluster storage system 716 and to each of the computing units 702A to 702D in the cluster computing system 700. The communications bus 714 may also be used for communications among the computing units 702A to 702D and the cluster storage system 716. In addition to the communications bus 714, a high-speed bus 718 can be present to increase the communications rate between the computing units 702A to 702D and/or the cluster storage system 716.

In some embodiments, the one or more non-transitory, computer-readable storage media of the cluster storage system 716 include storage arrays 720A, 720B, 720C and 720D for the storage of models, data, visual representations, results (such as graphs, charts, and the like used to convey results obtained using the present techniques), code, and other information concerning the implementation of at least a portion of the present techniques. The storage arrays 720A to 720D may include any combinations of hard drives, optical drives, flash drives, or the like.

Each computing unit 702A to 702D includes at least one processor 722A, 722B, 722C and 722D and associated local non-transitory, computer-readable storage media, such as a memory device 724A, 724B, 724C and 724D and a storage device 726A, 726B, 726C and 726D, for example. Each processor 722A to 722D may be a multiple core unit, such as a multiple core central processing unit (CPU) or a graphics processing unit (GPU). Each memory device 724A to 724D may include ROM and/or RAM used to store program instructions for directing the corresponding processor 722A to 722D to implement at least a portion of the present techniques. Each storage device 726A to 726D may include one or more hard drives, optical drives, flash drives, or the like. In addition, each storage device 726A to 726D may be used to provide storage for models, intermediate results, data, images, or code used to implement at least a portion of the present techniques.

The present techniques are not limited to the architecture or unit configuration illustrated in FIG. 7. For example, any suitable processor-based device may be utilized for implementing at least a portion of the embodiments described herein, including (without limitation) personal computers, laptop computers, computer workstations, mobile devices, and multi-processor servers or workstations with (or without) shared memory. Moreover, the embodiments described herein may be implemented, at least in part, on application specific integrated circuits (ASICs) or very-large-scale integrated (VLSI) circuits. In fact, those skilled in the art may utilize any number of suitable structures capable of executing logical operations according to the embodiments described herein.

Figure 8:
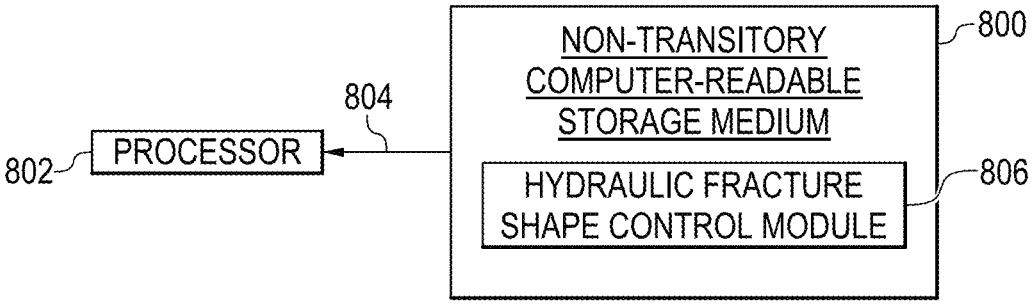
FIG. 8 is a block diagram of an exemplary non-transitory, computer-readable storage medium that may be used for the storage of data and modules of program instructions for implementing at least a portion of the present techniques.

FIG. 8 is a block diagram of an exemplary non-transitory, computer-readable storage medium (or media) 800 that may be used for the storage of data and modules of program instructions for implementing at least a portion of the present techniques. The non-transitory, computer-readable storage medium (or media) 800 may include one or more memory devices, one or more storage devices, and/or any other suitable type(s) of device(s), such as those described with respect to the cluster computing system 700 of FIG. 7. A processor 802 may access the non-transitory, computer-readable storage medium 800 over a bus or network 804. While the non-transitory, computer-readable storage medium 800 may include any number of modules for implementing the present techniques, in some embodiments, the non-transitory, computer-readable storage medium 800 includes a hydraulic fracture shape control module 806 for performing the techniques described herein (and/or any suitable variations thereof), as described with respect to the process 500 of FIG. 5 and/or the method 600 of FIG. 6, for example.

In one or more embodiments, the present techniques may be susceptible to various modifications and alternative forms, such as the following embodiments as noted in paragraphs 1 to 20:

1. A method for controlling the growth of a hydraulic fracture using a stress shadow generated during a hydraulic fracturing operation, including: selecting a stage pair including a first stage and a second stage for which hydraulic fractures are to be generated via a hydraulic fracturing operation; hydraulic fracturing the first stage to generate a corresponding first hydraulic fracture; controlling a magnitude of a stress shadow originating from the first hydraulic fracture by varying at least one parameter of the hydraulic fracturing operation, where the stress shadow is controlled so as to provide a second hydraulic fracture of a target fracture shape for the second stage; and hydraulic fracturing the second stage to generate the second hydraulic fracture with the target fracture shape.

2. The method of paragraph 1, including executing the method for a group of stages including at least one additional stage by: hydraulic fracturing the at least one additional stage to generate at least one corresponding hydraulic fracture; controlling magnitudes of stress shadows originating from the first hydraulic fracture and the at least one additional hydraulic fracture by varying at least one parameter of the hydraulic fracturing operation, where the stress shadows are controlled so as to provide the second hydraulic fracture with the target fracture shape.

3. The method of paragraph 1 or 2, where the at least one parameters includes at least one of: a number of stage buffers; a well spacing; a well stacking; a fracture order; a time between the hydraulic fracturing of the first stage and the second stage; a stage spacing; a cluster spacing; a cluster orientation; a number of clusters in a stage; a pad design; a number of fracture crews per development; a fracture plug design; a pressure in at least one interacting well; or a fracturing fluid design.

4. The method of any of paragraphs 1 to 3, further including, prior to the hydraulic fracturing of the second stage, assessing the magnitude of the stress shadow using at least one of fracture diagnostics or fracture modeling.

5. The method of any of paragraphs 1 to 4, further including, if the magnitude of the stress shadow has not been effectively controlled, varying at least one other parameter of the hydraulic fracturing operation prior to the hydraulic fracturing of the second stage.

6. The method of paragraph 4, including selecting the stage pair including the first stage and the second stage by: selecting a stage of a first well as the first stage; and selecting a corresponding stage of a second well in an adjoining bench as the second stage.

7. The method of any of paragraphs 1 to 6, including selecting the stage pair including the first stage and the second stage by: selecting a stage of a parent well as the first stage; and selecting a corresponding stage of a child well as the second stage; and where controlling the magnitude of the stress shadow originating from the first hydraulic fracture for the first stage corresponding to the parent well by varying the at least one parameter of the hydraulic fracturing operation includes increasing a pressure in the parent well to temporarily increase the magnitude of the stress shadow originating from the first hydraulic fracture while the second stage corresponding to the child well is hydraulically fractured.

8. The method of any of paragraphs 1 to 7, further including predetermining the target fracture shape for the second hydraulic fracture based on at least one of net pay maps or data from previous production operations.

9. The method of any of paragraphs 1 to 8, where the first stage is positioned at least partially above the second stage, where the target fracture shape includes a large lateral dimension to cover a wider area within a corresponding bench, and where controlling the magnitude of the stress shadow originating from the first hydraulic fracture by varying the at least one parameter of the hydraulic fracturing operation includes setting the at least one parameter such that a higher magnitude stress shadow is achieved so as to generate the second hydraulic fracture in a primarily lateral direction.

10. The method of any of paragraphs 1 to 9, where the first stage is positioned at least partially to one side of the second stage, where the target fracture shape includes a large vertical dimension, and where controlling the magnitude of the stress shadow originating from the first hydraulic fracture by varying the at least one parameter of the hydraulic fracturing operation includes setting the at least one parameter such that a higher magnitude stress shadow is achieved so as to generate the second hydraulic fracture in a primarily vertical direction.

11. The method of any of paragraphs 1 to 10, including executing the method for a number of stage pairs to generate a number of corresponding hydraulic fractures with target fracture shapes.

12. The method of paragraph 11, including: generating a modified well spacing plan for a field in which the wells corresponding to the number of stage pairs are located, where the modified well spacing plan includes fewer wells than an original well spacing plan; and implementing the modified well spacing plan in the field, where the modified well spacing plan results in a substantially similar amount of hydrocarbon production as compared to the original well spacing plan.

13. The method of paragraph 11, including: generating a modified completion plan for at least one drilled but uncompleted well that is located in a field in which the wells corresponding to the number of stage pairs are located, where the modified completion plan includes a lower fracturing fluid utilization than an original completion plan; and implementing the modified completion plan in the field, where the modified completion plan results in a substantially similar amount of hydrocarbon production as compared to the original completion plan.

14. A hydrocarbon well system, including: a first well in a first bench; a second well in a second bench, where the first bench and the second bench are positioned such that interacting hydraulic fractures can be generated for corresponding stages of the first well and the second well, where a first stage of the first well includes a corresponding first hydraulic fracture, where a second stage of the second well includes a second hydraulic fracture of a target fracture shape, where the first hydraulic fracture is generated prior to the second hydraulic fracture, and where a magnitude of a stress shadow originating from the first hydraulic fracture during a corresponding hydraulic fracturing operation is utilized to provide the target fracture shape for the second hydraulic fracture; and a computing system that is communicably coupled to the first well and the second well, where the computing system includes: a processor; and a non-transitory, computer-readable storage medium including program instructions that are executable by the processor to cause the processor to control the magnitude of the stress shadow originating from the first hydraulic fracture by varying at least one parameter of the hydraulic fracturing operation.

15. The hydrocarbon well system of paragraph 14, including at least one additional well with at least one corresponding hydraulic fracture, where the magnitudes of stress shadows originating from the first hydraulic fracture and the at least one additional hydraulic fracture during the hydraulic fracturing operation are utilized to provide the target fracture shape for the second hydraulic fracture.

16. The hydrocarbon well system of paragraph 14 or 15, where the at least one parameters includes at least one of: a number of stage buffers; a well spacing; a well stacking; a fracture order; a time between the hydraulic fracturing of the first stage and the second stage; a stage spacing; a cluster spacing; a cluster orientation; a number of clusters in a stage; a pad design; a number of fracture crews per development; a fracture plug design; a pressure in at least one interacting well; or a fracturing fluid design.

17. The hydrocarbon well system of any of paragraphs 14 to 16, where the non-transitory, computer-readable storage medium further includes program instructions that are executable by the processor to cause the processor to assess the magnitude of the stress shadow using at least one of fracture diagnostics or fracture modeling, prior to generation of the second hydraulic fracture.

18. The hydrocarbon well system of paragraph 17, where the non-transitory, computer-readable storage medium further includes program instructions that are executable by the processor to cause the processor to further control the magnitude of the stress shadow originating from the first hydraulic fracture by varying at least one other parameter of the hydraulic fracturing operation.

19. The hydrocarbon well system of any of paragraphs 14 to 18, where the non-transitory, computer-readable storage medium further includes program instructions that are executable by the processor to cause the processor to predetermine the target fracture shape for the second hydraulic fracture based on at least one of net pay maps or data from previous production operations.

20. The hydrocarbon well system of any of paragraphs 14 to 19, where the first stage is positioned at least partially above the second stage, where the target fracture shape includes a large lateral dimension to cover a wider area within the second bench, and where the non-transitory, computer-readable storage medium includes program instructions that are executable by the processor to cause the processor to control the magnitude of the stress shadow originating from the first hydraulic fracture by setting the at least one parameter such that a higher magnitude stress shadow is achieved so as to generate the second hydraulic fracture in a primarily lateral direction.

21. The hydrocarbon well system of any of paragraphs 14 to 20, where the first stage is positioned at least partially to one side of the second stage, where the target fracture shape includes a large vertical dimension, and where the non-transitory, computer-readable storage medium includes program instructions that are executable by the processor to cause the processor to control the magnitude of the stress shadow originating from the first hydraulic fracture by setting the at least one parameter such that a higher magnitude stress shadow is achieved so as to generate the second hydraulic fracture in a primarily vertical direction.

22. The hydrocarbon well system of any of paragraphs 14 to 21, where the second well includes a number of additional hydraulic fractures that are generated with target fracture shapes using a number of corresponding stages of the first well.

23. The hydrocarbon well system of any of paragraphs 14 to 22, where the non-transitory, computer-readable storage medium further includes program instructions that are executable by the processor to cause the processor to generate a modified well spacing plan for a field in which the first well and the second well are located, where the modified well spacing plan includes fewer wells than an original well spacing plan while still providing for a substantially similar amount of hydrocarbon production as compared to the original well spacing plan.

24. The hydrocarbon well system of any of paragraphs 14 to 23, where the non-transitory, computer-readable storage medium further includes program instructions that are executable by the processor to cause the processor to generate a modified completion plan for at least one drilled but uncompleted well that is located in a field in which the first well and the second well are located, where the modified completion plan includes a lower fracturing fluid utilization than an original completion plan while still providing for a substantially similar amount of hydrocarbon production as compared to the original completion plan.

While the embodiments described herein are well-calculated to achieve the advantages set forth, it will be appreciated that such embodiments are susceptible to modification, variation, and change without departing from the spirit thereof. In other words, the particular embodiments described herein are illustrative only, as the teachings of the present techniques may be modified and practiced in different but equivalent manners apparent to those skilled in the art having the benefit of the teachings herein. Moreover, the systems and methods illustratively disclosed herein may suitably be practiced in the absence of any element that is not specifically disclosed herein and/or any optional element disclosed herein. While compositions and methods are described in terms of "comprising" or "including" various components or steps, the compositions and methods can also "consist essentially of" or "consist of" the various components and steps. Indeed, the present techniques include all alternatives, modifications, and equivalents falling within the true spirit and scope of the appended claims.

What is claimed is:

1. A method for controlling the growth of a hydraulic fracture using a stress shadow generated during a hydraulic fracturing operation, comprising:

selecting a stage pair comprising a first stage and a second stage for which hydraulic fractures are to be generated via a hydraulic fracturing operation;

hydraulic fracturing the first stage to generate a corresponding first hydraulic fracture;

controlling a magnitude of a stress shadow originating from the first hydraulic fracture by varying at least one parameter of the hydraulic fracturing operation, wherein the stress shadow is controlled so as to provide a second hydraulic fracture of a target fracture shape for the second stage; and hydraulic fracturing the second stage to generate the second hydraulic fracture with the target fracture shape.

2. The method of claim 1, comprising executing the method for a group of stages comprising at least one additional stage by:

hydraulic fracturing the at least one additional stage to generate at least one corresponding hydraulic fracture; and controlling magnitudes of stress shadows originating from the first hydraulic fracture and the at least one additional hydraulic fracture by varying at least one parameter of the hydraulic fracturing operation, where the stress shadows are controlled so as to provide the second hydraulic fracture with the target fracture shape.

3. The method of claim 1, wherein the at least one parameters comprises at least one of:

a number of stage buffers;
a well spacing;
a well stacking;
a fracture order;
a time between the hydraulic fracturing of the first stage and the second stage;
a stage spacing;
a cluster spacing;
a cluster orientation;
a number of clusters in a stage;
a pad design;
a number of fracture crews per development;
a fracture plug design;
a pressure in at least one interacting well; or
a fracturing fluid design.

4. The method of claim 1, further comprising, prior to the hydraulic fracturing of the second stage, assessing the magnitude of the stress shadow using at least one of fracture diagnostics or fracture modeling.

5. The method of claim 4, further comprising, if the magnitude of the stress shadow has not been effectively controlled, varying at least one other parameter of the hydraulic fracturing operation prior to the hydraulic fracturing of the second stage.

6. The method of claim 1, comprising selecting the stage pair comprising the first stage and the second stage by:

selecting a stage of a first well as the first stage; and selecting a corresponding stage of a second well in an adjoining bench as the second stage.

7. The method of claim 1, comprising selecting the stage pair comprising the first stage and the second stage by:

selecting a stage of a parent well as the first stage; and selecting a corresponding stage of a child well as the second stage; and wherein controlling the magnitude of the stress shadow originating from the first hydraulic fracture for the first stage corresponding to the parent well by varying the at least one parameter of the hydraulic fracturing operation comprises increasing a pressure in the parent well to temporarily increase the magnitude of the stress shadow originating from the first hydraulic fracture while the second stage corresponding to the child well is hydraulically fractured.

8. The method of claim 1, further comprising predetermining the target fracture shape for the second hydraulic fracture based on at least one of net pay maps or data from previous production operations.

9. The method of claim 1, wherein the first stage is positioned at least partially above the second stage, wherein the target fracture shape comprises a large lateral dimension to cover a wider area within a corresponding bench, and wherein controlling the magnitude of the stress shadow originating from the first hydraulic fracture by varying the at least one parameter of the hydraulic fracturing operation comprises setting the at least one parameter such that a higher magnitude stress shadow is achieved so as to generate the second hydraulic fracture in a primarily lateral direction.

10. The method of claim 1, wherein the first stage is positioned at least partially to one side of the second stage, wherein the target fracture shape comprises a large vertical dimension, and wherein controlling the magnitude of the stress shadow originating from the first hydraulic fracture by varying the at least one parameter of the hydraulic fracturing operation comprises setting the at least one parameter such that a higher magnitude stress shadow is achieved so as to generate the second hydraulic fracture in a primarily vertical direction.

11. The method of claim 1, comprising executing the method for a plurality of stage pairs to generate a plurality of corresponding hydraulic fractures with target fracture shapes.

12. The method of claim 11, comprising:

generating a modified well spacing plan for a field in which the wells corresponding to the plurality of stage pairs are located, wherein the modified well spacing plan comprises fewer wells than an original well spacing plan; and implementing the modified well spacing plan in the field, wherein the modified well spacing plan results in a substantially similar amount of hydrocarbon production as compared to the original well spacing plan.

13. The method of claim 11, comprising:

generating a modified completion plan for at least one drilled but uncompleted well that is located in a field in which the wells corresponding to the plurality of stage pairs are located, wherein the modified completion plan comprises a lower fracturing fluid utilization than an original completion plan; and implementing the modified completion plan in the field, wherein the modified completion plan results in a substantially similar amount of hydrocarbon production as compared to the original completion plan.

14. A hydrocarbon well system, comprising:

a first well in a first bench;

a second well in a second bench, wherein the first bench and the second bench are positioned such that interacting hydraulic fractures can be generated for corresponding stages of the first well and the second well, wherein a first stage of the first well comprises a corresponding first hydraulic fracture, wherein a second stage of the second well comprises a second hydraulic fracture of a target fracture shape, wherein the first hydraulic fracture is generated prior to the second hydraulic fracture, and wherein a magnitude of a stress shadow originating from the first hydraulic fracture during a corresponding hydraulic fracturing operation is utilized to provide the target fracture shape for the second hydraulic fracture; and a computing system that is communicably coupled to the first well and the second well, wherein the computing system comprises:

a processor; and a non-transitory, computer-readable storage medium comprising program instructions that are executable by the processor to cause the processor to control the magnitude of the stress shadow originating from the first hydraulic fracture by varying at least one parameter of the hydraulic fracturing operation.

15. The hydrocarbon well system of claim 14, comprising at least one additional well with at least one corresponding hydraulic fracture, wherein the magnitudes of stress shadows originating from the first hydraulic fracture and the at least one additional hydraulic fracture during the hydraulic fracturing operation are utilized to provide the target fracture shape for the second hydraulic fracture.

16. The hydrocarbon well system of claim 14, wherein the at least one parameters comprises at least one of:

a number of stage buffers;

a well spacing;

a well stacking;

a fracture order;

a time between the hydraulic fracturing of the first stage and the second stage;

a stage spacing;

a cluster spacing;

a cluster orientation;

a number of clusters in a stage;

a pad design;

a number of fracture crews per development;

a fracture plug design;

a pressure in at least one interacting well; or a fracturing fluid design.

17. The hydrocarbon well system of claim 14, wherein the non-transitory, computer-readable storage medium further comprises program instructions that are executable by the processor to cause the processor to assess the magnitude of the stress shadow using at least one of fracture diagnostics or fracture modeling, prior to generation of the second hydraulic fracture.

18. The hydrocarbon well system of claim 17, wherein the non-transitory, computer-readable storage medium further comprises program instructions that are executable by the processor to cause the processor to further control the magnitude of the stress shadow originating from the first hydraulic fracture by varying at least one other parameter of the hydraulic fracturing operation.

19. The hydrocarbon well system of claim 14, wherein the non-transitory, computer-readable storage medium further comprises program instructions that are executable by the processor to cause the processor to predetermine the target fracture shape for the second hydraulic fracture based on at least one of net pay maps or data from previous production operations.

20. The hydrocarbon well system of claim 14, wherein the first stage is positioned at least partially above the second stage, wherein the target fracture shape comprises a large lateral dimension to cover a wider area within the second bench, and wherein the non-transitory, computer-readable storage medium comprises program instructions that are executable by the processor to cause the processor to control the magnitude of the stress shadow originating from the first hydraulic fracture by setting the at least one parameter such that a higher magnitude stress shadow is achieved so as to generate the second hydraulic fracture in a primarily lateral direction.

21. The hydrocarbon well system of claim 14, wherein the first stage is positioned at least partially to one side of the second stage, wherein the target fracture shape comprises a large vertical dimension, and wherein the non-transitory, computer-readable storage medium comprises program instructions that are executable by the processor to cause the processor to control the magnitude of the stress shadow originating from the first hydraulic fracture by setting the at least one parameter such that a higher magnitude stress shadow is achieved so as to generate the second hydraulic fracture in a primarily vertical direction.

22. The hydrocarbon well system of claim 14, wherein the second well comprises a plurality of additional hydraulic fractures that are generated with target fracture shapes using a plurality of corresponding stages of the first well.

23. The hydrocarbon well system of claim 14, wherein the non-transitory, computer-readable storage medium further comprises program instructions that are executable by the processor to cause the processor to generate a modified well spacing plan for a field in which the first well and the second well are located, wherein the modified well spacing plan comprises fewer wells than an original well spacing plan while still providing for a substantially similar amount of hydrocarbon production as compared to the original well spacing plan.

24. The hydrocarbon well system of claim 14, wherein the non-transitory, computer-readable storage medium further comprises program instructions that are executable by the processor to cause the processor to generate a modified completion plan for at least one drilled but uncompleted well that is located in a field in which the first well and the second well are located, wherein the modified completion plan comprises a lower fracturing fluid utilization than an original completion plan while still providing for a substantially similar amount of hydrocarbon production as compared to the original completion plan.

* * * * *